United States Patent [19]

Provence et al.

[11] Patent Number: 4,927,168

[45] Date of Patent: May 22, 1990

[54] CROSS-COUNTRY SKI BINDING

[75] Inventors: Marc Provence, Thornes-Les-Glieres; Didier Rousset, Lescheraines, both of France

[73] Assignee: Salomon, S.A., Annecy Cedex, France

[21] Appl. No.: 359,438

[22] Filed: May 31, 1989

[30] Foreign Application Priority Data

Jun. 9, 1988 [FR] France ..... 88 08034

[51] Int. Cl.[5] ..... A63C 9/18

[52] U.S. Cl. ..... 280/615; 280/631

[58] Field of Search ..... 280/614, 615, 626, 631

[56] References Cited

FOREIGN PATENT DOCUMENTS 375835 9/1984 Austria .
0156159 2/1985 European Pat. Off. .
0176952 9/1985 European Pat. Off. .
2590490 5/1987 France .
2606656 5/1988 France .

*Primary Examiner*—Charles A. Marmor
*Assistant Examiner*—Eric Culbreth
*Attorney, Agent, or Firm*—Sandler, Greenblum & Bernstein

[57] ABSTRACT

A cross-country ski binding that includes a first axis about which a shoe rotates in relation to the ski and a second axis of rotation for a retention or bridling stirrup that acts on the front end of the shoe. An elastic member biases the stirrup in the direction of bridling the shoe and also exerts a return force on the shoe when it is lifted from the upper surface of the ski. A transmission plate is journalled to the ski at a lower end and at the upper end to a connecting rod that is in turn journalled to the stirrup. The transmission plate transmits the forces of the elastic member to the stirrup.

13 Claims, 3 Drawing Sheets

CROSS-COUNTRY SKI BINDING

BACKGROUND OF THE INVENTION

1. Field of the Invention

The present invention relates to a binding for latching a shoe or boot on a cross-country ski and for allowing rotation of the shoe with respect to an axis perpendicular to the longitudinal axis of the ski. The binding is of the type comprising a bridling stirrup for connecting a shoe on the ski and acting on the front end thereof and being journalled on the ski around an axis perpendicular to the longitudinal axis of the ski. The stirrup is biased in rotation by an elastic element in the direction of the bridling of the shoe. The elastic element exerts a return force on the shoe when it is lifted from the upper surface of the ski.

2. Description of Background and Relevant Information

A cross-country binding of the above-mentioned type is known, for example, from European Application 0,156,159. In this binding, the shoe is bridled between its axis of rotation and the stirrup. The angle of rotation of the shoe or boot is limited by the abutment of its front end against the binding itself. The angle of rotation of the shoe is thus limited by that of the stirrup and barely exceeds 40°.

Yet it is presently desirable to have angles of rotation of the shoe with respect to the ski which are greater than 40°.

SUMMARY OF THE INVENTION

According to the present invention, there is disclosed a cross-country ski binding for latching a shoe or boot on a cross-country ski and for allowing a greater angle of rotation of the shoe or boot about an axis substantially perpendicular to the longitudinal axis of the ski. The shoe or boot is provided at its front end with a journal about which the shoe or boot rotates. The binding includes a journal which is complementary to the journal of the shoe or boot. A bridling stirrup is adapted to act on the front end of the shoe or boot and is journalled on the ski around an axis substantially perpendicular to the longitudinal axis of the ski. The stirrup is biased by an elastic element for rotation in the direction of bridling of the shoe or boot. The term "bridling" as used herein is to be understood in the sense of retention and assembly of the shoe or boot on the ski. The elastic element also exerts a return force on the shoe or boot when it is lifted from the upper surface of the ski. An element is positioned in front of and at a distance from the stirrup which is constituted by a transmission plate for transmission of the forces of the elastic element. The lower end of the plate is journalled on the ski and the upper end of the plate is journalled on a connecting rod. The transmission plate is substantially parallel to the bridling stirrup when in its rest position.

According to a further aspect of the invention, the ski binding includes a guiding bearing which is adapted to receive a transverse axis for rotational movement, the guiding bearing being affixed to the front end of the shoe or boot. The transverse axis of the guiding bearing is positioned in front of the journal axis of the bridling stirrup. The bearing is upwardly open and has a U-shaped cross-section. The median plane of the bearing is inclined towards the front of the ski at an angle of inclination of said of approximately 30° with respect to the vertical.

According to another aspect of the invention, the ski binding includes an engagement ramp provided on the upper rear edge of the guiding bearing.

According to further aspects of the invention, a cross-country binding includes engaging for rotation a portion of a shoe or boot relative to the ski. A rotatable bridling stirrup engages a front portion of the shoe or boot and retains the shoe or boot with the binding.

An elastic device exerts a force on the shoe or boot for opposing rotation thereof and a transmission plate transmits the force of the elastic device to the shoe or boot. The transmission plate includes an upper portion and a lower portion and is rotatable relative to the ski at the lower portion. A connecting member is journalled to the upper portion of the transmission plate and is also journalled to the bridling stirrup. The connecting member extends between the transmission plate and the front of the shoe or boot when the shoe or boot is retained by the binding, and thereby establishes a space between the transmission plate and the front of the shoe or boot before the shoe or boot is rotated substantially from the ski.

According to another aspect of the invention, are binding stirrup and connecting member are operably associated for permitting the front of the shoe or boot to move toward the transmission plate as the shoe or boot rotates from the ski and reduces the space between the transmission plate and the front of the shoe or boot. The binding is configured and arranged for permitting said shoe or boot to be rotated approximately 60 degrees away from said ski.

BRIEF DESCRIPTION OF THE DRAWINGS

The binding of the invention is further explained, and other characteristics thereof will become clear from the description which follows with reference to the annexed schematic drawings which illustrate, by way of non-limiting example, a preferred embodiment in which.

DETAILED DESCRIPTION OF THE PREFERRED EMBODIMENT

Objects of the present invention include providing a binding of the above type which allows a greater angle of rotation of the shoe, while still preserving a simple and sturdy construction. These objects are achieved by elastic elements exerting their force on a stirrup by means of a transmission element situated in front of and at a distance from this stirrup.

This arrangement makes it possible to form a free space in front of the stirrup which is adapted to receive the front end or nose of the shoe or boot during the rotation thereof and thus makes it possible to increase the angle of rotation of the shoe or boot.

According to a preferred embodiment, the transmission element for the forces is constituted by a plate journalled on the ski by its lower end, and journalled on the stirrup at its upper end by a connecting rod. In this manner, the entire space positioned between the rear surface of the transmission plate and the stirrup can be utilized for receiving the nose of the shoe or boot during the rotation thereof.

Figure 1:
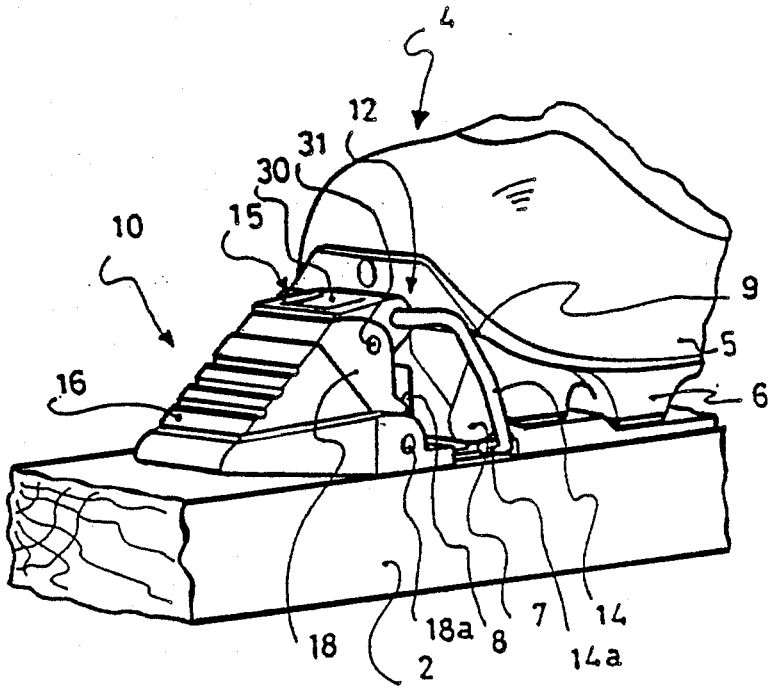
FIG. 1 is a perspective view of the binding and shoe or boot before insertion thereof into the binding.

FIG. 1 shows a binding 10 according to the invention adapted to be affixed to a cross-country ski 2, having a longitudinal axis 3, for the latching thereon of a shoe or boot 4. The shoe or boot 4 comprises, in a known manner, an upper 5 and sole 6. At the front end of the sole 6, two side plates 7 serve to support a transverse axle 8 that is adapted to extend substantially perpendicularly to the longitudinal axis 3 of the ski in the latched position of the shoe or boot.

The shoe or boot likewise has on the front end of its sole 6, two support surfaces 9 adapted to cooperate, as will be seen below, with an associated bridling element of the binding 10. These two support surfaces 9 are positioned laterally on the front end of the nose of the shoe or boot.

It will be noted that the terms "front" and "rear" refer to the front and rear of the ski, respectively.

Figure 2:
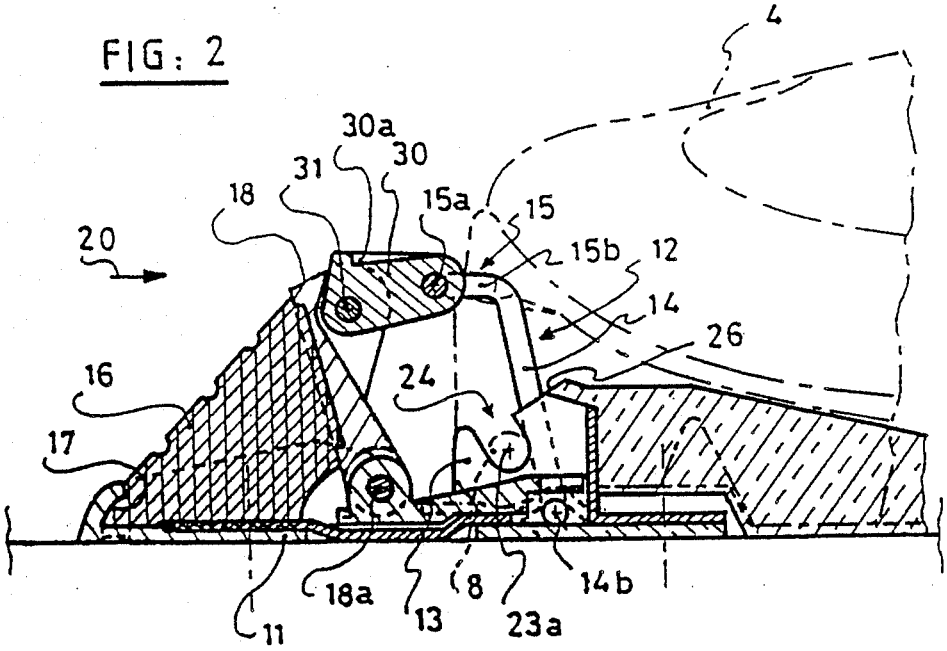
FIG. 2 is a longitudinal cross-sectional view of the binding of FIG. 1, the shoe or boot being shown in phantom lines.
Figure 3:
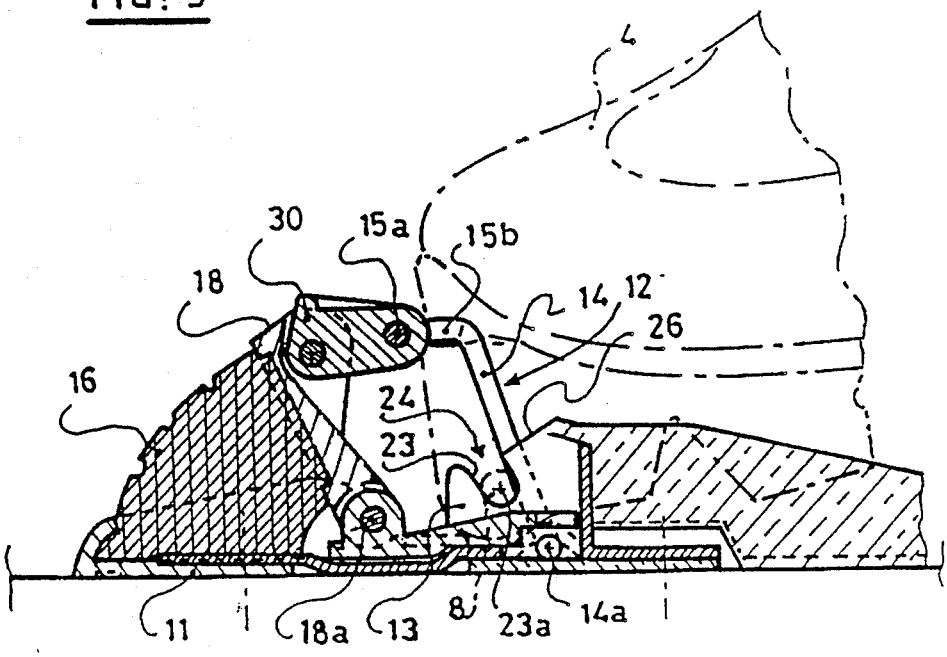
FIGS. 3 and 4 are views similar to FIG. 2 at different pivoting positions of the shoe or boot.

As seen in particular in FIG. 2, the binding 10 includes essentially a base 11 adapted to be affixed to the upper surface of the ski by any appropriate means, such as screwing, gluing, etc. A bridling stirrup 12 is journalled on base 11. A bearing 13 is adapted to receive a journal axle 8 of the shoe or boot and to allow for the rotation thereof in a counterclockwise direction with respect to axle 8.

As more particularly seen in FIG. 1, the bridling stirrup 12 has essentially a U-shape and thus includes two lateral arms 14 connected by a transverse member 15 extending substantially parallel to the upper surface of the ski.

The U-shaped stirrup is journalled on base 11 by the curved end 14*a* by each of its arms 14 defining a rotation axis 14*b*, and is adapted to bridle or retain the shoe or boot 4 on the ski by cooperation of its transverse member 15 with the support surfaces 9 of the shoe or boot. In the present case, the stirrup 12 is constituted by a round steel wire but can be formed in any other manner.

The U-shaped stirrup is biased in rotation towards the rear, i.e., the direction indicated in FIG. 2 by the arrow 20 (clockwise), by an elastic bumper 16 positioned in an associated seat 17 of base 11. Such an elastic bumper 16 can be replaced by any elastic means such as a spring, etc. The elastic bumper 16 serves not only to bias stirrup 12 in rotation in the clockwise direction, that is, in the direction of bridling of the shoe or boot 4, but also opposes the rotation of the shoe in the counterclockwise direction around its axle 8 and, thus, exerts thereon a return force on the shoe or boot when it is lifted from the upper surface of the ski. The force exerted by bumper 16 is transmitted to stirrup 12 by means of a transmission plate 18 positioned in front of and at a distance from stirrup 12. The transmission plate is connected to the stirrup 12 at its upper end by means of a connecting rod 30.

In the disclosed embodiment, connecting rod 30 is journalled at one end to the upper end of the transmission plate 18 by an axle 31 and at the other end to the upper end of stirrup 12 by transverse member 15. The transverse member 15 of the stirrup has a median portion 15*a* which is offset towards the front for the journalling of the connecting rod 30. Two lateral portions 15*b* extend substantially in the same plane as the arms 14 of the stirrup and are adapted to cooperate with the lateral support surfaces 9 of the shoe or boot for the bridling thereof. The transmission plate 18 is journalled at its lower portion to the base 11 about an axis 18*a*.

It is noted that in this embodiment, the transmission plate 18, in the rest position, extends substantially parallel to the binding stirrup 12, and that the connecting rod 30 extends substantially parallel to the surface of the ski. The provision of the transmission plate 18 in front of and at a distance from the bridling stirrup 12 makes it possible to free a space adapted to receive the front end or nose of the shoe or boot 4 during the rotation thereof around its axle 8 during cross-country skiing. As no obstacle opposes the rotation of the shoe or boot in front thereof, the angular movement obtained will be much greater. In practice, the angle of rotation thus obtained for the shoe or boot is approximately 60°, which is very significant.

It is likewise noted that the connecting rod 30 makes it possible to separate the two functions of the bridling stirrup 12, that is, the bridling and the elastic biasing of the shoe or boot in the clockwise direction. In effect, in the binding as disclosed, the bridling is achieved by the stirrup alone, while elastic biasing is transmitted to the stirrup by means of transmission plate 18, which is positioned in front of the stirrup and the connecting rod 30.

In the embodiment shown, the connecting rod includes at its upper portion an opening 30*a* adapted to receive the end of a ski pole for the opening of the binding. Such an opening 30*a* could be provided, depending upon the design, on the transverse member of the stirrup or on another element of the binding.

The bearing 13 defines for the axle 8 of the shoe or boot a U-shaped housing 23, whose transverse axis 23*a* extends substantially perpendicularly to the longitudinal axis of the ski, and which is open at its upper portion 24. It is noted that the longitudinal axis 23*a* constitutes the axis of rotation of the shoe or boot when it is introduced into the housing 23.

Figure 4:
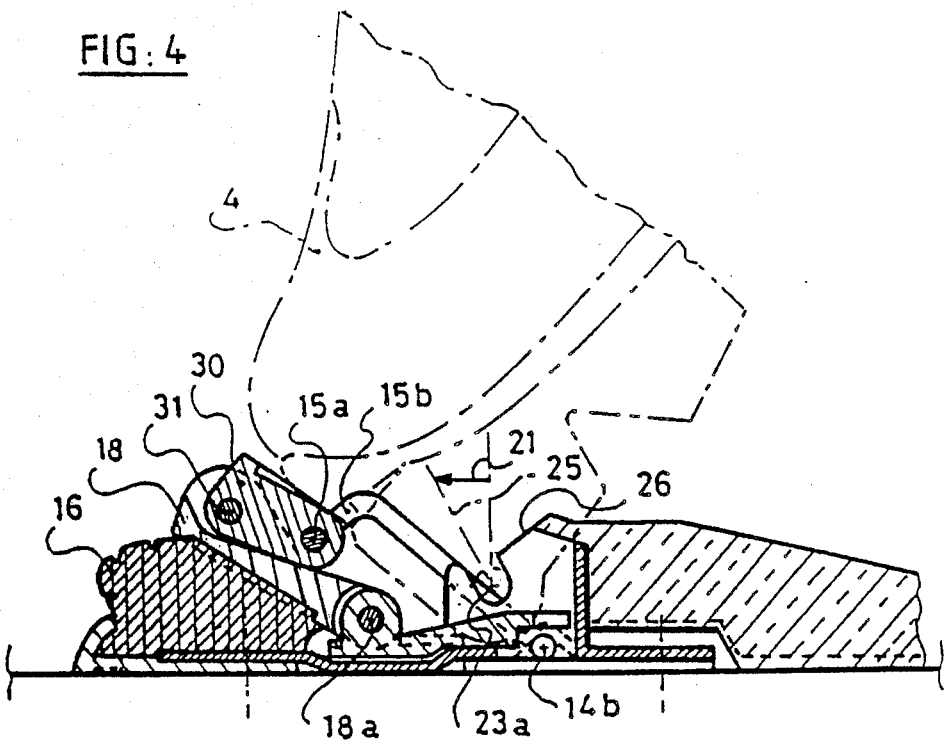
Figure 5:
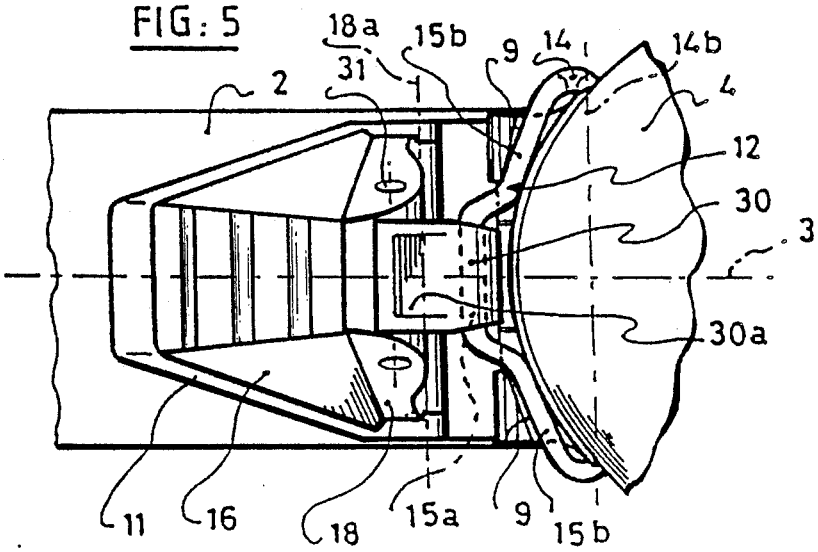
FIG. 5 is a top view of FIG. 1.

As is shown in FIG. 4, the median plane of housing 23, whose outline in the plane of this figure is indicated at 25, is inclined towards the front (i.e., in the direction indicated by the arrow 21) with respect to the vertical, the angle of inclination being approximately 30°.

Such a configuration makes it possible to avoid an accidental vertical displacement of the axle 8 of the shoe or boot in the latched position thereof, and thus makes it possible to avoid an undesired opening of the binding during skiing, and particularly during rotation of the shoe or boot around its axle 8.

An engagement ramp 26 is provided on the rear edge of the opening of housing 23 to facilitate the introduction of the shoe or boot. This ramp 26 is inclined forwardly and downwardly.

Although the invention has been described with reference to particular means, materials and embodiments, it is to be understood that the invention is not limited to the particulars disclosed and extends to all equivalents within the scope of the following claims.

What is claimed:

1. A cross-country ski binding for latching a shoe or boot on a cross-country ski and for allowing rotation of the shoe or boot about an axis substantially perpendicular to the longitudinal axis of the ski, the shoe or boot being provided at its front end with a journal element, said binding comprising:

journal means complementary to and for cooperation with the journal element of the shoe or boot, a bridling stirrup for engagement with the front end of the shoe or boot, said bridling stirrup being journalled on the ski for movement about an axis substantially perpendicular to the longitudinal axis of the ski, said bridling stirrup being biased by an elastic device, said elastic device also exerting a return force on the shoe or boot when it is lifted from the upper surface of the ski while retained thereon by said bridling stirrup, an element positioned in front of and at a distance from said bridling stirrup, said element comprising a transmission plate for transmission of the forces of said elastic device, the lower end of said plate being journalled relative to the ski, said binding further comprising a connecting rod, wherein said upper end of said plate is journalled on said connecting rod, said connecting rod being journalled on said bridling stirrup, wherein said elastic device exerts said return force on said bridling stirrup by said plate.

2. The cross-country ski binding according to claim 1, wherein said transmission plate extends substantially parallel to said bridling stirrup when in a rest position.

3. The cross-country ski binding according to claim 1, further comprising a guiding bearing adapted to receive, for rotational movement, a transverse axle affixed to the front end of the shoe or boot.

4. The cross-country ski binding according to claim 3, wherein the transverse axis of said guiding bearing is positioned in front of the journal axis of said bridling stirrup.

5. The cross-country ski binding according to claim 3, wherein said guiding bearing is upwardly open.

6. The cross-country ski binding according to claim 5, wherein said guiding bearing has a U-shaped cross-section.

7. The cross-country ski binding according to claim 5, wherein said guiding bearing has a transverse median plane which is inclined towards the front of the ski.

8. The cross-country ski binding according to claim 7, wherein the angle of inclination of said median plane of said guiding bearing is approximately 30° with respect to the vertical.

9. The cross-country ski binding according to claim 5, further comprising an engagement ramp provided on the upper rear edge of said bearing.

10. A cross-country binding comprising:

(a) means for engagement with a portion of a shoe or boot for permitting rotation of said shoe or boot relative to said ski;

(b) a bridling stirrup for engagement with a front portion of said shoe or boot for retaining said shoe or boot with said binding, said bridling stirrup being rotatable relative to said ski;

(c) an elastic device for exerting a force on said shoe or boot for opposin rotation thereof;

(d) a transmission plate for transmitting said force of said elastic device to said shoe or boot, said transmission plate having an upper portion and a lower portion and being rotatable relative to said ski at said lower portion; and (e) a connecting member journalled to said upper portion of said transmission plate and also journalled to said bridling stirrup.

11. The cross-country binding of claim 10 wherein said connecting member extends between said transmission plate and the front of said shoe or boot when said shoe or boot is retained by said binding, thereby establishing a space between said transmission plate and the front of said shoe or boot before said shoe or boot is rotated substantially from said ski.

12. The cross-country binding of claim 11 wherein said binding stirrup and said connecting member are operably associated for permitting sad front of said shoe or boot to move toward said transmission plate as said shoe or boot rotates from said ski and to reduce said space between said transmission plate and the front of said shoe or boot.

13. The cross-country binding of claim 12 wherein said binding is configured and arranged for permitting said shoe or boot to be rotated approximately 60 degrees away from said ski.

* * * * *

UNITED STATES PATENT AND TRADEMARK OFFICE

CERTIFICATE OF CORRECTION

PATENT NO. : 4,927,168

DATED : May 22,1990

INVENTOR(S) : M. PROVENCE et al.

It is certified that error appears in the above-identified patent and that said Letters Patent is hereby corrected as shown below:

On the front page, change the inventor's address from "Thornes-Les-Glieres" to —Thorens-Les-Glieres—.

Column 2, line 25, change "are" to —the—.

Column 6, line 15, in claim 10, change "opposin" to —opposing—.

Column 6, line 33, in claim 12, change "sad" to —said—.

Signed and Sealed this

Seventeenth Day of December, 1991

*Attest:*

*Attesting Officer*

HARRY F. MANBECK, JR.

*Commissioner of Patents and Trademarks*